US005989205A

United States Patent [19]

Pond et al.

[11] Patent Number: 5,989,205

[45] Date of Patent: Nov. 23, 1999

[54] SOLUTION APPLICATOR SYSTEM

[75] Inventors: Gary J. Pond, Racine, Wis.; Michael S. Butler, Round Lake Heights, Ill.

[73] Assignee: Inter-Med, LLC., Racine, Wis.

[21] Appl. No.: 09/074,944

[22] Filed: May 8, 1998

[51] Int. Cl.[6] ..... A61M 35/00; B65D 83/10; B65D 69/00; A61B 17/06

[52] U.S. Cl. ..... 604/3; 206/362; 206/363; 206/368; 206/438; 206/443; 206/570; 206/572

[58] Field of Search ..... 206/361, 362, 206/363, 368, 438, 443, 557, 570, 572; 604/1–3

[56] References Cited

U.S. PATENT DOCUMENTS

| | | | |
|---|---|---|---|
| 1,637,153 | 7/1927 | Lawton . | |
| 3,643,812 | 2/1972 | Mander et al. | 211/74 |
| 3,835,834 | 9/1974 | Brown et al. | 604/3 |
| 3,913,564 | 10/1975 | Freshley | 206/368 |
| 4,211,323 | 7/1980 | Olsen | 206/210 |
| 4,510,119 | 4/1985 | Hevey | 422/71 |
| 4,887,994 | 12/1989 | Bedford . | |
| 4,986,289 | 1/1991 | McWhorter . | |
| 5,112,297 | 5/1992 | Stalup et al. . | |
| 5,203,450 | 4/1993 | Benetti . | |
| 5,240,415 | 8/1993 | Haynie . | |
| 5,350,059 | 9/1994 | Chester et al. . | |
| 5,378,226 | 1/1995 | Hanifl et al. . | |
| 5,429,229 | 7/1995 | Chester et al. . | |
| 5,538,129 | 7/1996 | Chester et al. . | |
| 5,636,736 | 6/1997 | Jacobs et al. . | |

*Primary Examiner*—John G. Weiss
*Assistant Examiner*—Dennis Ruhl
*Attorney, Agent, or Firm*—Ryan Kromholz & Manion, S.C.

[57] ABSTRACT

A solution applicator system comprising a retainer and a plurality of solution retaining containers removably coupled to the retainer. Each container has a removable end and a closed end and includes a receptacle, having an open end and a sealing structure sealing the open end, and an applicator member, having at least one end coupled to an absorbing material, both housed within the container.

4 Claims, 3 Drawing Sheets

SOLUTION APPLICATOR SYSTEM

BACKGROUND OF THE INVENTION

The present invention relates generally to dental products and more specifically to applicators for applying a solution to a patient's teeth and gums.

Several dental procedures incorporate the use of solution applicators. Commonly, applicators are used in applying a prophylactic solution, such as fluoride, or a topical anesthetic solution, such as benzocaine, to certain areas of a patient's mouth. Dentists commonly apply prophylactic solution, such as fluoride, to children's teeth, but also to adults, in order to fight cavities and other diseases of the mouth. Topical anesthetics are widely used to locally anesthetize a particular area of the mouth prior to an injection or prior to other dental procedures not requiring a deep anesthesia.

Usually, fluoride and topical anesthetics are supplied in bulk, in jars or other containers, for repetitive use by dentists or other dental professionals. The dentist dips a cotton swab or other absorbing material into the container and allows some of the solution to be absorbed by the swab. The dentist then applies the swab to a local area in the patient's mouth. This typical procedure has certain drawbacks. First, the container is used for multiple applications, creating the risk of contamination. Second, the dentist cannot assess the exact quantity of solution being applied. If the material absorbs too much fluoride or anesthetic, dripping can occur leading to a dirty work place and waste. On the other hand, too much solution may be applied to the area of the mouth, creating discomfort to the patient. If the material absorbs less solution than necessary, a subsequent application may be required leading to another time consuming procedure and to the use of another applicator.

Several solutions to these common problems have been proposed, but it appears that none were successful.

For example, U.S. Pat. No. 5,112,297 to Stalcup teaches an improved applicator for applying a topical anesthetic to a patient's mucosal tissue including a sponge-like dispenser member attached to an elongated handle. A predetermined quantity of the anesthetic is pre-applied to the dispenser member. A number of these applicators are stored in a refillable dispenser apparatus having a number of wells, each receiving one dispenser member. However, the Stalcup patent teaches away from the individual coating of the dispenser member.

It is an object of the present invention to provide a solution applicator system that allows safe and secure handling of the solution. It is an object of this invention to provide a solution applicator system that is easy to use and that is appealing to children. It is another object of this invention to provide such a system that allows easy removal and discarding of used applicators and containers. It is further an object of this invention to provide a convenient system of individual application without having to expose and possibly contaminate the solution or the applicators in the other containers.

SUMMARY OF THE INVENTION

The present invention relates generally to dental products and specifically to a solution applicator system for applying prophylactic or anesthetic solution to a patient's mouth.

In one preferred embodiment, the solution applicator system comprises a plurality of removable containers and a retaining structure housing the containers. Preferably, the retaining structure includes a plurality of dome shaped housings, each housing receiving one of the containers. It must be understood that the housings could be of any other shape.

Each container has an open end and comprises a solution retaining receptacle and an applicator member located within the container. The receptacle has an open end and a sealing structure sealing the open end. The receptacle contains the solution to be applied. The applicator member comprises a handle having absorbing material, preferably hydrophilic foam, coupled to one of its ends. In the preferred embodiment and prior to use, the applicator member within the container and on the sealing structure of the receptacle. The end of the handle of the applicator member coupled to the absorbing material further includes a tip, sufficiently rigid to permit perforation of the sealing structure.

After removing the container from the retaining structure, the user applies pressure to the applicator member and onto the sealing structure, until the tip of the applicator member punctures the sealing structure. By doing so, the user introduces the absorbing material into the receptacle and allows for the complete absorption of the solution. Finally, the user removes the applicator member from the container and applies the solution to the teeth and gums, discarding the used container and applicator afterwards.

In an alternate embodiment, the solution applicator system comprises an individual container having a removable top. The removable top of the container can be flat or dome-shaped, although any other shape could as well be provided. In this alternate embodiment, the user must first remove and discard the removable top, and then follow the same steps required for the preferred embodiment.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
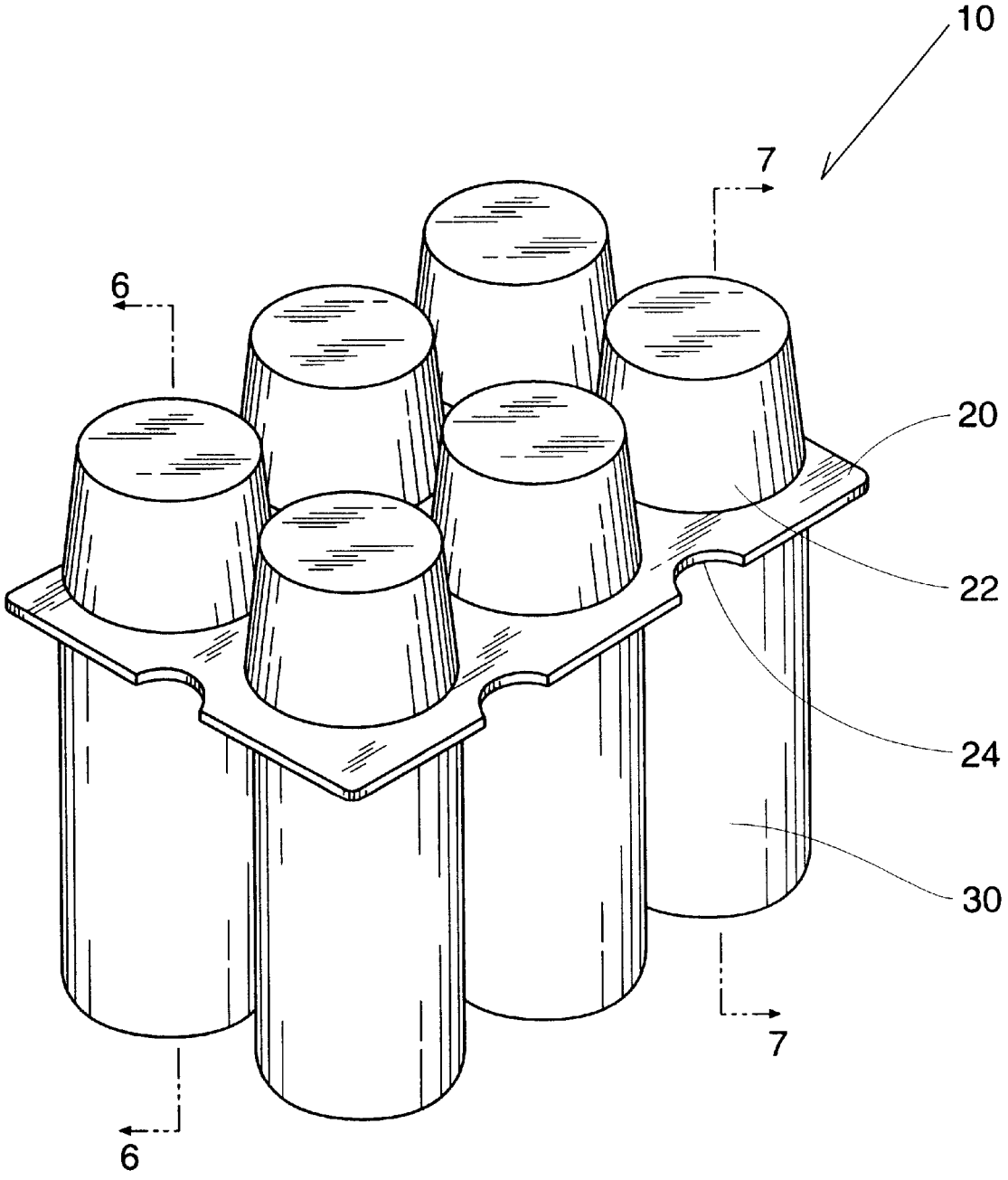
FIG. 1 is a perspective view of the invention showing the retaining structure and several containers.

The preferred embodiment of the solution applicator system, designated generally as 10, is illustrated in FIG. 1.

Referring to FIG. 1, the solution applicator system 10 comprises a retainer 20 and several solution-retaining containers 30. Preferably, the retainer 20 has a rectangular shape, although it must be understood that it could be of any other shape. The retainer 20 is preferably unitary and is preferably formed of a simple molding, either pressure or vacuum formed. The molded retainer 20 includes a plurality of integrally formed housings 22, preferably six for a compact appearance and convenience in handling. Each housing 22 is dome-shaped, although a different shape could as well be provided, and receives one solution-retaining container 30. In its preferred embodiment, the retainer 20 further includes a predetermined number of notches 24, carved within the retainer's lateral edge. Preferably, the notches 24 are semi-circular to allow comfortable and easy handling, although any other shape could provide the same basic function. Each container 30 is individually removable and can be separated from the retainer 20 without destroying the integrity of the remaining structure.

Figure 5:
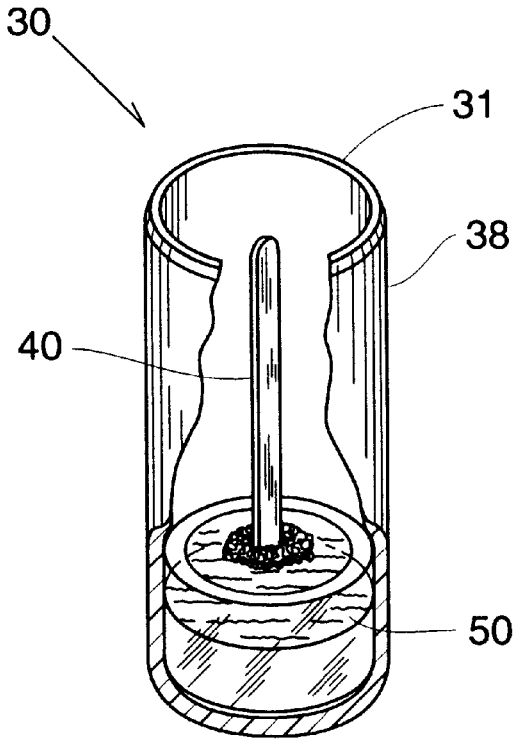
FIG. 5 is a perspective cut-away view of a container showing the applicator member immersed into the solution retaining receptacle.

As shown in FIG. 5, the container 30 comprises an open end 31, a body 38, an applicator 40, and a solution-retaining receptacle 50. The container 30 has a cylindrical shape to fit within any one housing 22. It must be understood that the container 30 could be shaped differently and still provide the same function.

Figure 2:
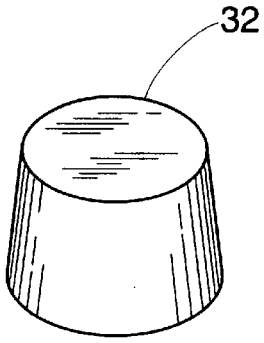
FIG. 2 is a perspective view of the flat-shaped removable top of the container.
Figure 3:
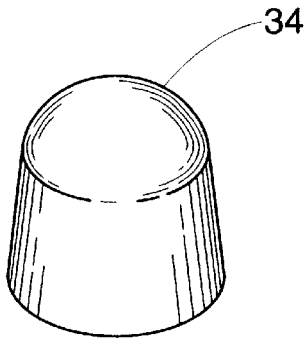
FIG. 3 is a perspective view showing an alternate dome-shaped embodiment of the removable top of the container.
Figure 4:
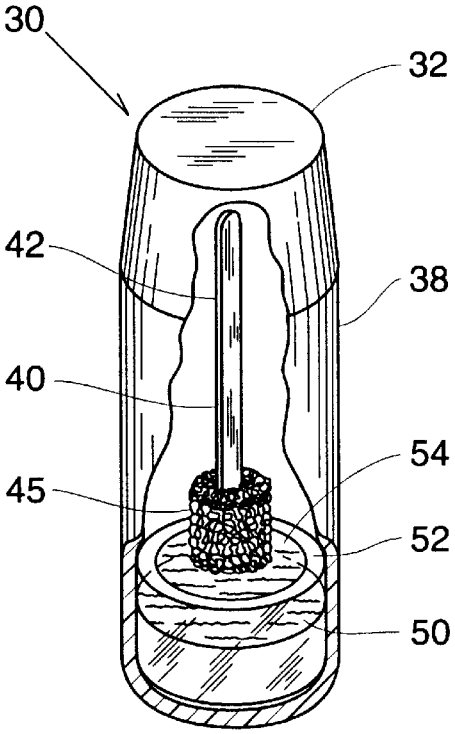
FIG. 4 is a perspective cut-away view of a container.

FIG. 4 shows an alternate embodiment of the solution applicator system 10 where the container 30 is individually provided with a removable top 32. As shown in FIGS. 2 and 3, the removable top 32 is preferably flat, although it could alternatively have a dome shape or any other shape . In this alternate embodiment, containers 30 are separately provided, without the need for a retainer 20.

Figure 6:
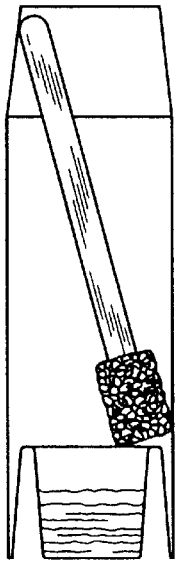
FIG. 6 is a sectional view of a container taken along lines 6—6 showing the applicator member resting on top of the sealing structure.
Figure 7:
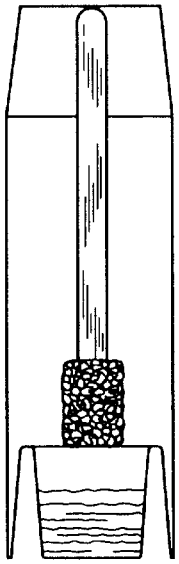
FIG. 7 is a sectional view of a container taken along lines 7—7 showing the applicator member resting perpendicularly on top of the sealing structure.

Referring back to FIG. 4, the receptacle 50 is adjacently fitted within the container 30. The receptacle 50 contains a predetermined amount of the solution to be applied, namely the fluoride, the anesthetic, or any other necessary solution The receptacle 50 has an open end 52 facing the removable top 32 of the container 30 and a sealing foil 54, or other sealing material, sealing the open end 52 and protecting the solution from spillage. Resting on top of the sealing foil 54 and within the container 30 is an applicator 40. The applicator 40 is dimensioned to fit inside the container 30. As shown in FIGS. 6 and 7, the applicator 40 can move freely inside the container 30 and can take various positions as illustrated.

Figure 8:
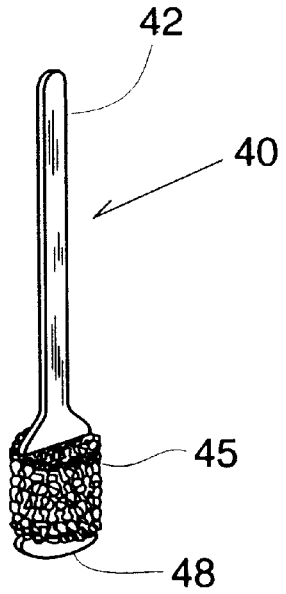
FIG. 8 is a perspective view of an applicator member.

Referring to FIG. 8, the applicator 40 includes a handle 42 having an absorbing material 45 at one of its ends. The handle 42 is preferably made out of wood or plastic, although any other similar material could be used, and is preferably injection molded, even though any other method of fabrication could be used. The absorbing material 45 is preferably hydrophilic foam with a capacity of 17 times absorption by weight which results in a 30% expansion of the volume of the material 45. Hydrophilic foam is preferred because of its absorbing properties and its capacity to expand and prevent dripping of the solution. The applicator 40 further includes a tip 48 located adjacently to the material 45. The tip 48 is sufficiently rigid to permit perforation of the foil 54 and is made out of the same material as the handle 42.

In accordance with the invention, the user removes the container 30 from the retainer 20 or, in the alternative, removes the top 32 from the individual container 30. Next, the user reaches inside the container 30 for the handle 42 of the applicator 40 and applies pressure to the sealing foil 54 of the receptacle 50 until the applicator punctures the foil 54. The applicator 40 and especially the tip 48 and the absorbing material 45 are sufficiently rigid to withstand the pressure exerted by the user and to permit perforation of the foil 54. As, the user inserts the material 45 portion of the applicator 40 into the receptacle 50, the hydrophilic foam material 45 absorbs substantially the entire quantity of solution existent in the receptacle 50, as illustrated in FIG. 5. FIG. 5 shows the material 45 immersed into the receptacle 50. After the material 45 has reached its expanded volume, the user removes the applicator from the container 30 and applies the solution to the intended area of the mouth. After application of the solution to the user's mouth, the user must discard the applicator 40 and the container 30.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A solution applicator system comprising:

a retaining structure;

a plurality of containers each having an open end;

said retaining structure being coupled to and enclosing said open end of said containers;

an applicator member housed within each of said containers;

each of said applicator member having at least one end including an absorbing material attached thereto;

each of said containers further including a solution-retaining receptacle, said receptacle having an open end and puncturable sealing means sealing said open end;

said one end of said applicator member being sufficiently rigid to puncture said sealing means of said receptacle; and each solution-retaining receptacle being inwardly spaced from said open end of said container.

2. The solution applicator system of claim 1, wherein said containers are removably coupled to said retaining structure.

3. The solution applicator system of claim 1, wherein said absorbing material comprises hydrophilic foam.

4. The solution applicator system of claim 1, wherein each of said applicator members is respectively positioned between said sealing means and said open end of each said container.

* * * * *